US006994418B2

(12) United States Patent
Nishioka

(10) Patent No.: US 6,994,418 B2
(45) **Date of Patent: *Feb. 7, 2006**

(54) HEAD MAINTENANCE MECHANISM FOR INK JET PRINTER AND INK JET PRINTER INCORPORATING THE SAME

(75) Inventor: Atsushi Nishioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/829,232

(22) Filed: Apr. 22, 2004

(65) Prior Publication Data

US 2004/0196327 A1 Oct. 7, 2004

Related U.S. Application Data

(63) Continuation of application No. 10/303,087, filed on Nov. 25, 2002, now Pat. No. 6,746,098.

(30) Foreign Application Priority Data

Nov. 26, 2001 (JP) ..... P2001-359921

(51) Int. Cl.
*B41J 2/165* (2006.01)

(52) U.S. Cl. ..... 347/29; 347/30; 347/32

(58) Field of Classification Search ..... 347/22–35
See application file for complete search history.

(56) References Cited

U.S. PATENT DOCUMENTS

| | | | | |
|---|---|---|---|---|
| 4,825,231 | A | 4/1989 | Nozaki | |
| 5,733,055 | A | 3/1998 | Hiramatsu et al. | |
| 5,831,644 | A | 11/1998 | Kato | |
| 5,971,520 | A | 10/1999 | Nakahara | |
| 6,312,093 | B1 | 11/2001 | Saijo et al. | |
| 6,402,289 | B2 | 6/2002 | Nitta | |
| 6,533,387 | B2 | 3/2003 | Simmons et al. | |
| 6,746,098 | B2 * | 6/2004 | Nishioka | 347/29 |
| 2001/0002838 | A1 | 6/2001 | Nakahara | |
| 2001/0028373 | A1 | 10/2001 | Iwaya et al. | |

FOREIGN PATENT DOCUMENTS

| | | |
|---|---|---|
| EP | 0 850 773 | 7/1998 |
| EP | 0 972 648 | 1/2000 |
| JP | 2-263655 | 10/1990 |
| JP | 6-262768 | 9/1994 |
| JP | 9-109380 | 4/1997 |
| JP | 2000-141673 | 5/2000 |
| JP | 2001-270126 | 10/2001 |
| JP | 2002-036604 | 2/2002 |
| JP | 2002-137408 | 5/2002 |

* cited by examiner

*Primary Examiner*—Shih-Wen Hsieh
(74) *Attorney, Agent, or Firm*—Nixon & Vanderhye P.C.

(57) ABSTRACT

A head cap is reciprocally movable between a capping position for covering nozzles of a print head and a retracted position separated from the nozzle surface. A pump is connected to the head cap. A pump gear is rotated by a drive source to drive the pump. A cylindrical cam is reciprocally rotatable between a first position and a second position to reciprocally move the head cap. A frictional clutch rotates the cylindrical cam together with the pump gear, but rotates only the pump gear when the cylindrical cam reaches each one of the first position and the second position.

20 Claims, 12 Drawing Sheets

HEAD MAINTENANCE MECHANISM FOR INK JET PRINTER AND INK JET PRINTER INCORPORATING THE SAME

CROSS-REFERENCES TO RELATED APPLICATIONS

This application is a continuation of U.S. patent application Ser. No. 10/303,087, filed Nov. 25, 2002 now U.S. Pat. No. 6,746,098. The entire contents of this application is incorporated herein by reference.

BACKGROUND OF THE INVENTION

The present invention relates to a head maintenance mechanism for a serial type ink jet printer in which a carriage mounting thereon a print head is reciprocated in a widthwise direction of printing. More specifically, the invention relates to a head maintenance mechanism in which a single rotary drive source is used to drive a head cap, wiper and an ink suction pump.

With a serial type ink jet printer, a head maintenance mechanism is arranged in a position outside a region of printing performed by a print head, and wiping of dirt on a nozzle surface of the print head, capping intended for prevention of plugging of a nozzle orifice, and an operation of sucking ink in an increased viscosity from the nozzle orifice are performed by the head maintenance mechanism. To meet the needs of making a head maintenance mechanism for an ink jet printer small-sized, compact and inexpensive, related art head maintenance mechanisms are constituted by a configuration in which a single rotary drive source, such as stepping motors or the like, is used to cause movement of a wiper for wiping a nozzle surface, a capping action of a head cap for capping the nozzle surface, and an operation of sucking ink from a nozzle orifice as capped.

For example, Japanese Patent Publication No. 2000-141673A discloses a head maintenance mechanism of such configuration. With the head maintenance mechanism disclosed in this publication, rotation of a single motor in one direction causes a head cap and a wiper to be driven through a slide type rack and a cam mechanism, and reverse rotation of the motor causes a diaphragm suction pump to be driven through a cylindrical cam.

However, a head maintenance mechanism of a type in which rotation of a single motor in one direction causes a head cap and a wiper to be driven, and reverse rotation of the motor causes a suction pump to be driven, involves the following problems.

First, a cylindrical cam is generally used to convert rotary movements of a motor into reciprocal movements. Since such a cylindrical cam is continuously rotationally driven in one direction, there is a need of providing a position detector for detecting a reference or initial position of the cylindrical cam in order to control respective motions of the cylindrical cam.

Also, there is a need of separately providing a power transmitting mechanism for driving of a head cap and a wiper and a power transmitting mechanism for driving of an ink suction pump, which is disadvantageous in making a head maintenance mechanism small-sized and compact.

Further, a pump, for example, a tube pump needed to rotate forward and rearward cannot be adopted as an ink suction pump. More specifically, in the case where a tube pump is used, a roller rotates flattening an ink tube to perform an ink sucking action when a pump gear being a drive force input element of the pump is rotated forward, and the roller is put in a release state, in which the ink tube is not flattened, when the pump gear is rotated rearward. Since the release state is necessary after the ink sucking action, a tube pump cannot be used in the case of rotary driving in one direction.

Also, a head maintenance mechanism for an ink jet printer involves as an ink sucking configuration from a head cap with an ink sucking action, the case where ink is sucked from a nozzle orifice and the case where ink accumulated in the head cap is sucked (idle suction) in a state in which the head cap made in capping is put in an atmospheric opening state. In order to realize both of these ink sucking configurations, it is necessary to provide a mechanism for opening and closing a vent valve mounted on a head cap after there is established a state in which the head cap caps the nozzle surface. When such mechanism can be made compact, it is advantageous in making a head maintenance mechanism small-sized, compact or thin.

SUMMARY OF THE INVENTION

An object of the invention is to propose a head maintenance mechanism for an ink jet printer which is capable of controlling motions of a head cap, wiper and an ink suction pump without the use of any position detector.

Also, an object of the invention is to propose a head maintenance mechanism for an ink jet printer which is capable of driving an ink suction pump forward and rearward.

Further, an object of the invention is to propose a head maintenance mechanism for an ink jet printer in which a power transmitting mechanism for driving a head cap, wiper and an ink suction pump can be made compact.

Further still, an object of the invention is to propose a head maintenance mechanism for an ink jet printer in which a mechanism for switching an interior of a head cap capping a nozzle surface between opening to the atmosphere and not opening is made compact.

In order to achieve the above objects, according to the present invention, there is provided a maintenance mechanism for a print head having a nozzle surface in which are formed a plurality of nozzles, comprising:

a head cap, reciprocally movable between a capping position for covering the nozzles and a retracted position separated from the nozzle surface;

a pump, connected to the head cap;

a drive source;

a pump gear, rotated by the drive source to drive the pump;

a cylindrical cam, reciprocally rotatable between a first position and a second position to reciprocally move the head cap; and a frictional clutch, which rotates the cylindrical cam together with the pump gear, but rotates only the pump gear when the cylindrical cam reaches each one of the first position and the second position.

Preferably, a cam groove is formed on an outer peripheral surface of the cylindrical cam in a predetermined circumferential angular range. The maintenance mechanism further comprises a cap driving pin slidably movable along the cam groove to reciprocally move the head cap.

Here, it is preferable that the maintenance mechanism further comprises an urging member which urges the cap driving pin toward a bottom surface of the cam groove.

Preferably, a first engagement member and a second engagement member are provided with the cylindrical cam, and a third engagement member is disposed at a predetermined position. A rotation of the cylindrical cam in a first direction is stopped when the first engagement member engages with the third engagement member, and a rotation of the cylindrical cam in a second direction is stopped when the second engagement member engages with the third engagement member.

Alternatively, it is preferable that a rotation of the cylindrical cam in a first direction is stopped when the cap driving pin reaches at a first dead end of the cam groove, and a rotation of the cylindrical cam in a second direction is stopped when the cap driving pin reaches at a second dead end of the cam groove.

Here, it is preferable that the pump gear and the cylindrical cam are coaxially arranged, so that they can be arranged in a compact manner.

Still here, it is preferable that the frictional clutch includes an urging member which presses one circular end surface of the pump gear and one circular end surface of the cylindrical cam together.

Further, it is preferable that the pump is a tube pump which performs a sucking operation only when the cylindrical cam is rotated in either one of the first direction and the second direction.

Here, it is preferable that the pump is arranged coaxially with the cylindrical cam.

Preferably, the head cap includes:

a cap body having an opening which faces the nozzle surface;

a cap holder, which holds the cap body;

an urging member, disposed in the cap holder to urge the cap body in a direction that the cap body is projected from the cap holder; and a vent valve, closed when the cap body of the head cap placed at the capping position is pushed toward the cap holder by a predetermined amount against an urging force of the urging member, so that an interior space of the head cap is isolated from atmosphere.

Here, it is preferable that the cam groove includes:

a first portion which moves the cap driving pin so as to place the cap holder at a first capping position where the cap body covers the nozzles and the vent valve is closed; and a second portion which moves the cap driving pin so as to place the cap holder at a second capping position where the cap body covers the nozzles and the vent valve is opened.

Still here, it is preferable that the cam groove includes a guide portion which guides the cap driving pin situated in the first portion to the second portion. The cap driving pin situated in the vicinity of one end of the first portion is guided to the second portion via the guide portion, when the cap driving pin is moved away from the one end of the first portion.

Still here, it is preferable that: the first portion includes a depth-decreasing portion in which a depth thereof gradually decreases toward the one end thereof; and the guide portion connects a part in the first portion in the vicinity of the depth-decreasing portion and the second portion.

Preferably, the cam groove is one continuous groove, and the predetermined circumferential angular range is 360 degrees or less.

Preferably, the maintenance mechanism further comprises an intermittent gear arranged coaxially with the cylindrical cam, so as to rotate integrally with the cylindrical cam. A driving force of the driving source is transmitted to the intermittent gear only in a predetermined circumferential angular range of the cylindrical cam between the first position and the second position.

Preferably, the maintenance mechanism further comprises:

a wiper, reciprocally movable between a wiping position for wiping the nozzle surface and a standby position; and a wiper driving pin, slidably moving along the cam groove to reciprocally move the wiper.

The cam groove includes:

a first dead end portion, at which the wiper driving pin is placed when a rotation of the cylindrical cam in a first direction is stopped;

a wiper driving portion, continued from the first dead end portion, which moves the wiper driving pin to reciprocally move the wiper;

a second dead end portion, at which the cap driving pin is placed when a rotation of the cylindrical cam in a second direction is stopped; and a cap driving portion, continued from the second dead end portion, which moves the cap driving pin to reciprocally move the head cap.

Here, it is preferable that the maintenance mechanism further comprises an intermittent gear arranged coaxially with the cylindrical cam, so as to rotate integrally with the cylindrical cam. A driving force of the drive source is transmitted to the intermittent gear only in a predetermined circumferential angular range of the cylindrical cam between the first dead end portion and the second dead end portion of the cam groove.

Here, it is preferable that the pump is a tube pump which performs a sucking operation only when the cylindrical cam is rotated in the second direction.

In the above configurations, the torque of a single drive source is transmitted to the cylindrical cam through the frictional clutch from the pump gear, and a finite rotation of the cylindrical cam causes at least one of the head cap and the wiper to move. Accordingly, it is possible to place the cylindrical cam of the finite rotation type in an initial or reference position without the use of a position detector for detecting the rotation angle of the cylindrical cam. Therefore, an inexpensive head maintenance mechanism easy to control can be realized.

Since there is no need of separately arranging the power transmitting mechanisms for the suction pump, the head cap and the wiper, it is possible to realize a small-sized and compact head maintenance mechanism.

Since forward and rearward rotations from the drive source can be transmitted to the suction pump, it is possible to switchingly control a state of a pump, such as a tube pump, by switching of a direction of rotation of the drive source.

Since the cam groove is formed so as to establish a state in which the head cap seals the nozzle surface, and a state in which the head cap seals the nozzle surface but the interior space of the head cap is communicated to atmosphere, there is no need of separately providing a drive mechanism for driving a valve mechanism for opening of the head cap to the atmosphere and it is possible to realize a small-sized and compact head maintenance mechanism.

Since the cylindrical cam, the pump gear and the suction pump are arranged in a coaxial manner, a predetermined space in a direction perpendicular to the coaxes can be saved so that a small-sized and compact head maintenance mechanism can be realized.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A preferred embodiment of a head maintenance mechanism of an ink jet printer according to the invention will be described below with reference to the accompanying drawings. Since the ink jet printer in which the head maintenance mechanism of the invention is incorporated is provided with a well-known structure, there will be omitted specific explanation and illustrations for the same.

Figure 1:
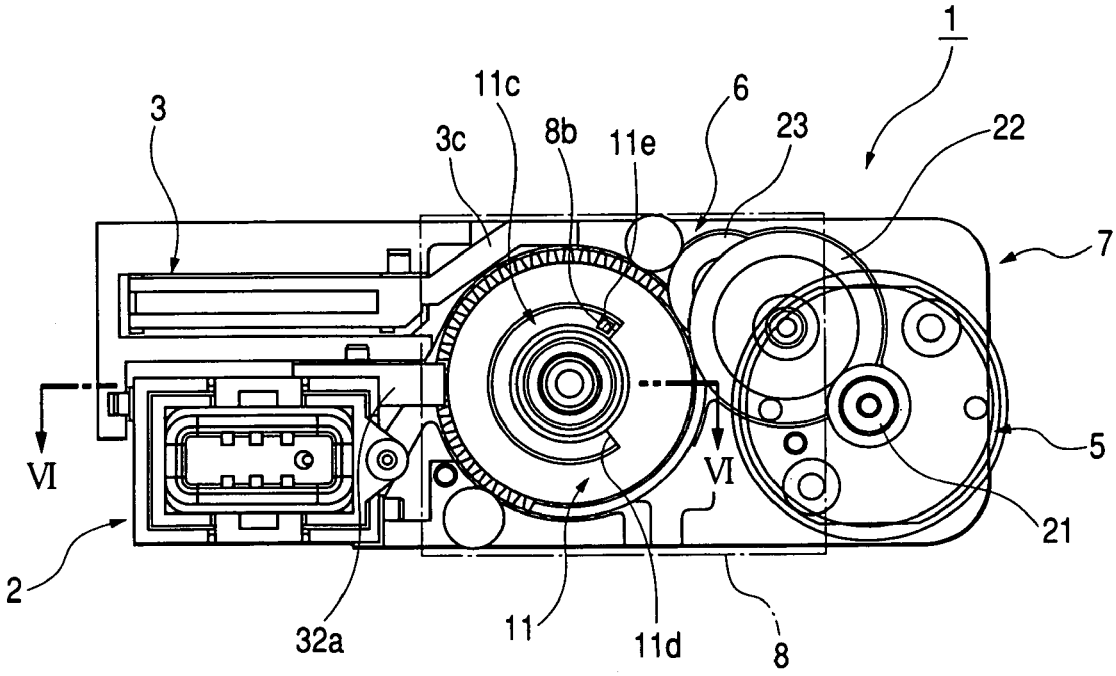
FIG. 1 is a plan view showing a head maintenance mechanism of an ink jet printer according to one embodiment of the invention.
Figure 2:
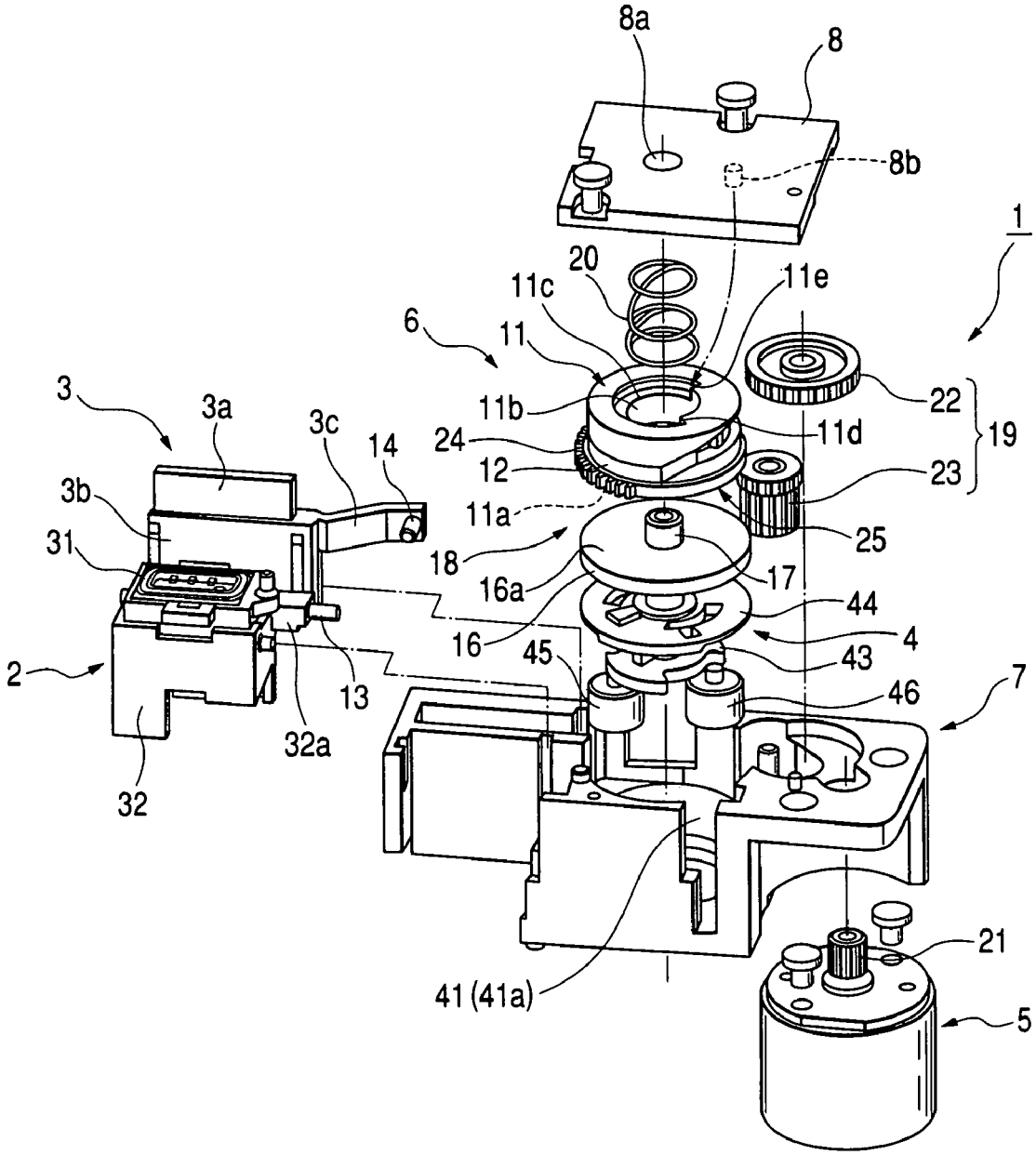
FIG. 2 is an exploded, perspective view showing the head maintenance mechanism of FIG. 1.

As shown in FIGS. 1 and 2, a head maintenance mechanism 1 comprises: a head cap 2 for capping a nozzle surface of a print head; a wiper 3 for wiping the nozzle surface; and a tube pump 4 as an ink suction pump for sucking ink from the head cap 2. Also, the head maintenance mechanism 1 further comprises a stepping motor 5 as a common drive source for driving the head cap 2, wiper 3, and the tube pump 4. Further, the head maintenance mechanism 1 comprises a power transmitting mechanism 6 for transmitting torque of the stepping motor 5 to the head cap 2, wiper 3, and the tube pump 4. These respective parts are mounted to a housing 7.

As shown in FIG. 2, the power transmitting mechanism 6 comprises a cylindrical cam 11, on an outer peripheral surface of which is formed a cam groove 12 having a predetermined depth in a circumferential direction. A cap driving pin 13 for movement of the head cap is inserted into the cam groove 12 in a state of being slidable along the cam groove 12 as the cylindrical cam 11 rotates. Also, a wiper driving pin 14 for movement of the wiper is inserted in a position offset clockwise substantially 90 degrees into the cam groove 12 in a state of being slidable along the cam groove 12 as the cylindrical cam 11 rotates. Further, a pump gear 16 being a drive power input element of the tube pump 4 is coaxially opposed to and disposed immediately below a circular bottom surface 11 a of the cylindrical cam 11.

Disposed immediately below the pump gear 16 is the tube pump 4, of which a central shaft 17 extends centrally through the pump gear 16 and the cylindrical cam 11 to project upward. The central shaft 17 has its lower end 17*a* rotatably supported on the housing 7 and its upper end 17*b* rotatably inserted into a shaft hole 8*a* formed in an upper wall 8 fixed to an upper surface of the housing by a pair of screws.

The cylindrical cam 11 and the pump gear 16 are held in frictional engagement by a frictional clutch mechanism 18. The frictional clutch mechanism 18 in the embodiment comprises the circular bottom surface 11*a*, an upper end surface 16*a* of the pump gear 16, and a coil spring 20 mounted in a central hole 11*b* of the cylindrical cam 11. The coil spring 20 is mounted in a compressed state between the cylindrical cam 11 and the upper wall 8 to constantly push the cylindrical cam 11 with a predetermined bias. Accordingly, the circular bottom surface 11*a* of the cylindrical cam 11 and the upper end surface 16*a* of the pump gear 16 are pushed together with a predetermined bias to be made rotatable together by frictional forces generated thereby. When load exceeding the frictional forces acts, sliding is established between both elements.

The pump gear 16 is connected to the stepping motor 5 through a reduction gear mechanism 19. The reduction gear mechanism 19 comprises a composite reduction gear 22 meshing with a motor gear 21 mounted on a motor shaft, and a reduction gear (drive gear) 23 meshing with a small-diameter gear 22*a* of the composite reduction gear 22, the reduction gear 23 meshing with the pump gear 16.

Here, the cylindrical cam 11 is formed at an outer peripheral surface of a lower end thereof with an intermittent gear 25, which is formed over an angular range of substantially 200 degrees with teeth 24. The teeth 24 can also mesh with the reduction gear 23.

Also, the cylindrical cam 11 in the embodiment is of finite rotation type, and there are provided rotation limiters for defining a clockwise dead end and a counterclockwise dead end. The rotation limiters in the embodiment comprise stopper walls 11*d*, 11*e* for defining both ends of an arcuate groove 11*c* formed over a predetermined angular range along an inner peripheral edge of an annular upper surface of the cylindrical cam 11, and a projection 8*b* projected into the arcuate groove 11*c* from the back of the upper wall 8. When the cylindrical cam 11 rotates clockwise, the stopper wall 11*d* strikes against (contacts) the projection 8*b* to inhibit rotation of the cylindrical cam 11. Also, when the cylindrical cam 11 rotates counterclockwise, the other stopper wall 11*e* strikes against (contacts) the projection 8*b* to inhibit rotation of the cylindrical cam 11.

With the power transmitting mechanism 6 in the embodiment constructed in this manner, rotation of the stepping motor 5 is transmitted to the pump gear 16 through the reduction gear mechanism 19, and rotation of the pump gear 16 is transmitted to the cylindrical cam 11 through the frictional clutch mechanism 18. Also, rotation of the stepping motor 5 is transmitted directly to the cylindrical cam 11 in a state, in which the intermittent gear 25 of the cylindrical cam 11 meshes with the reduction gear 23.

When the cylindrical cam 11 rotates, the cap driving pin 13 and the wiper driving pin 14, which are inserted into the cam groove 12 of the cam in predetermined positions, are moved in a direction (up and down direction in FIGS. 2 to 6) along an axis of rotation of the cylindrical cam 11 to afford a capping state by the head cap 2 and a wiping state by the wiper 3. Also, the tube pump 4 sucks ink from the head cap 2 put in the capping state.

Next, the construction of the head cap 2 in the embodiment will be described with reference to FIGS. 6 to 9. The head cap 2 comprises a box-shaped cap body 31 facing a nozzle surface 101 of a print head 100 and opened upward, and a cap holder 32 holding the cap body 31 in a state to receive the same from the upper opening. A horizontal arm 32*a* is projected from a side of the cap holder 32, and the cap driving pin 13 is inserted into a pin hole 32*b* formed on a tip end of the arm 32*a*. In the embodiment, a coil spring 32*c* inserted into the pin hole 32*b* constantly biases the cap driving pin 13 in a projecting direction from the pin hole 32*b*. Accordingly, a tip end of the cap driving pin 13 is constantly pushed against a bottom surface of the cam groove 12 of the cylindrical cam 11.

An ink absorbing member 33 is housed in the cap body 31, and ink recovered by the ink absorbing member 33 is discharged from an ink discharging port 34 formed in a bottom plate portion of the cap body 31.

Also, configured between the bottom plate portion of the cap body 31 and the cap holder 32 is a vent valve mechanism 35 for opening an interior of the cap body to the atmosphere. More specifically, a vent port 36 is extended downward from the bottom plate portion of the cap body 31, and a valve seat 37 is formed on the cap holder 32 to be opposed to a lower end of the vent port 36. The cap body 31 is mounted in a state to be vertically movable a predetermined amount with regard to the cap holder 32. Normally, the cap body 31 is biased upward by a coil spring 38, and therefore the vent port 36 is spaced away from the valve seat 37 to be held in an atmospheric opening state. When the cap body 31 is pressed a predetermined amount from above, a lower end of the vent port 36 abuts against the valve seat 37 to be closed thereby, and so the vent valve mechanism 35 is put in a closed state.

Figure 7:
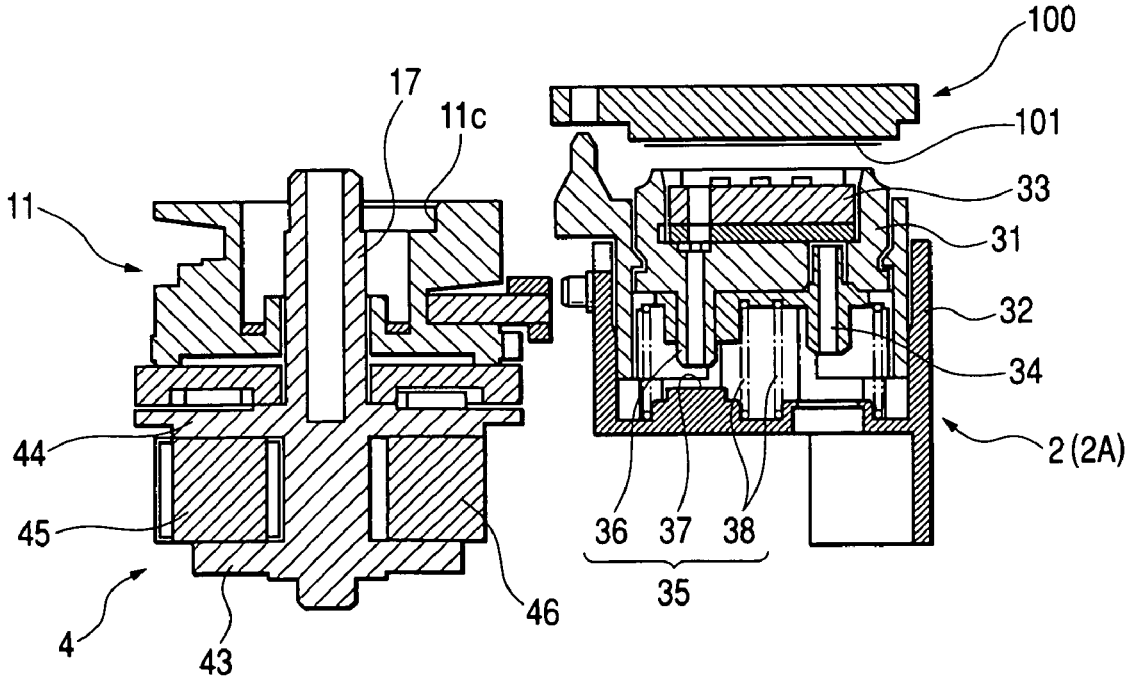
FIG. 7 is a partial, cross sectional view of the head cap taken along a line VII—VII in FIG. 3, and showing a state, in which a head cap is disposed in a retracted position.
Figure 8:
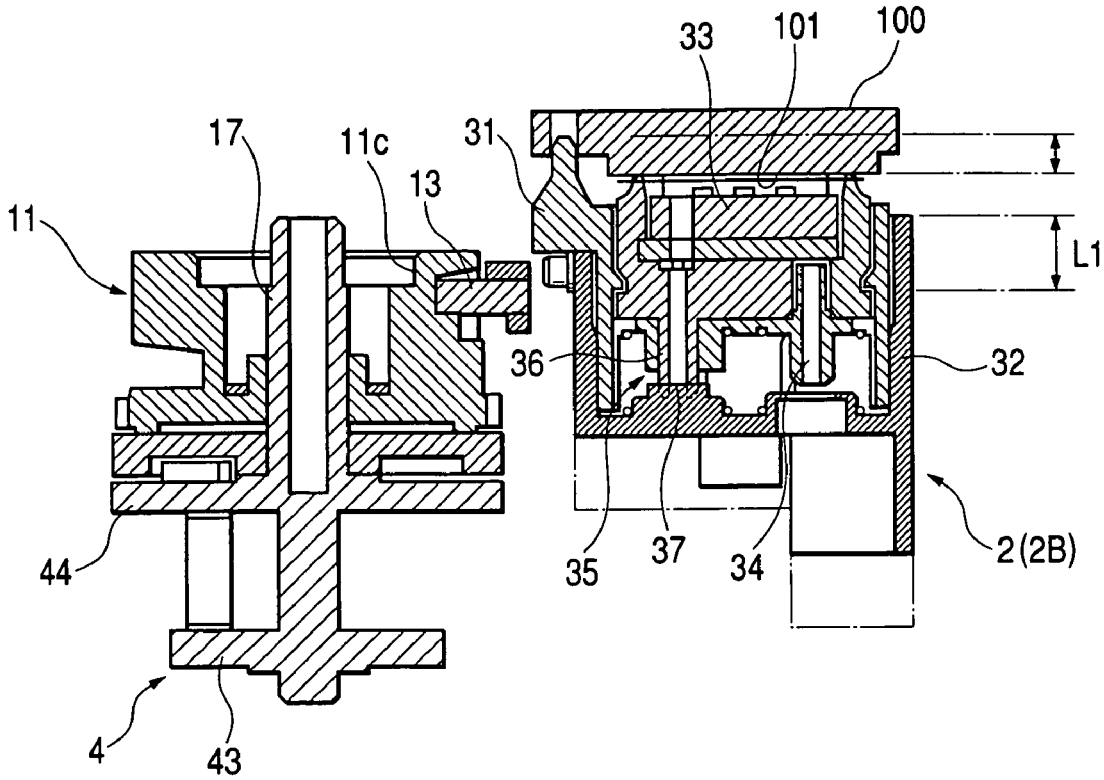
FIG. 8 is a partial, cross sectional view of the head cap taken along the line VII—VII in FIG. 3, and showing a capping state, in which the head cap is disposed in an ink sucking position.
Figure 9:
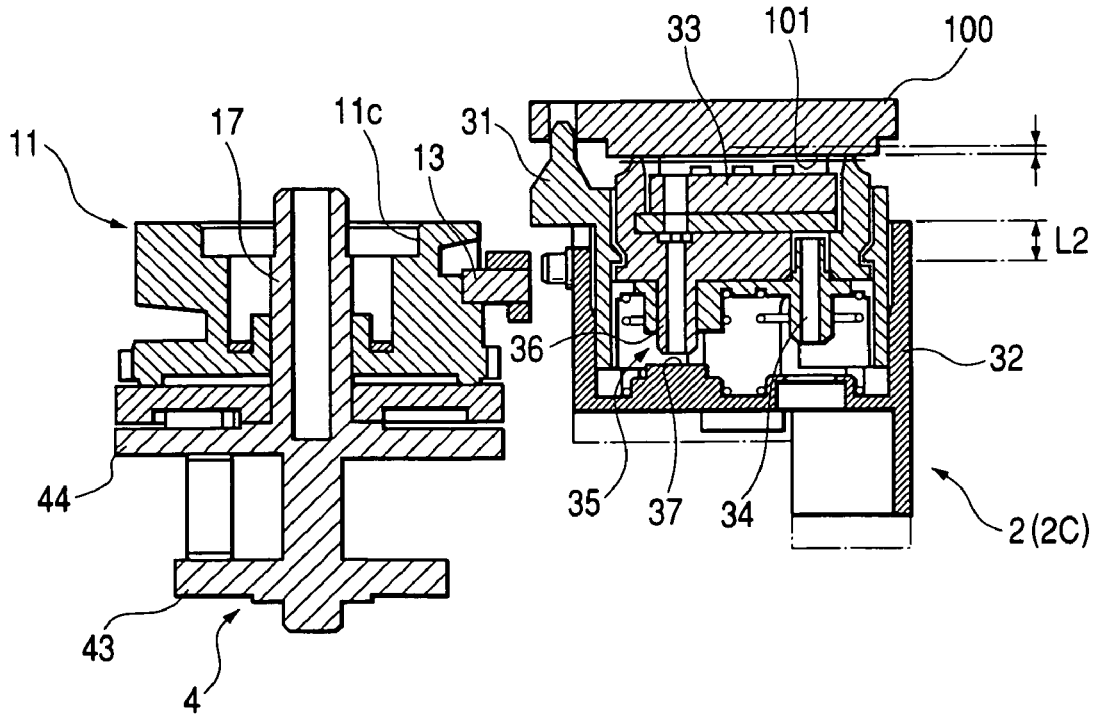
FIG. 9 is a partial, cross sectional view of the head cap taken along the line VII—VII in FIG. 3, and showing a capping state, in which the head cap is disposed in an idle sucking position.

In FIG. 7, the head cap 2 is in a state to be disposed in a retracted position 2A. In contrast, FIGS. 8 and 9 show a state in which the head cap 2 caps the nozzle surface 101. In a state shown in FIG. 8, the head cap 2 is disposed in an ink sucking position 2B in which capping is effected when the vent valve mechanism 35 is put in a closed state. In this position, the cap holder 32 rises a distance L1 from the retracted position 2A shown in FIG. 7 while the cap body 31 abuts against the nozzle surface 101 of the print head 100 disposed right above to be relatively pushed downward to have the vent port 36 seated on the valve seat 37. In this state, when the tube pump 4 performs an ink sucking action, ink is sucked from the nozzle orifice on the print head 100 to be discharged outside.

In contrast, FIG. 9 shows an idle sucking position 2C, in which the cap holder 32 rises a smaller distance L2 than the distance L1 from the retracted position 2A and the cap body 31 caps the nozzle surface 101, but the vent valve mechanism 35 is remained in a opened state since the lift L2 is small. In this state, when the tube pump 4 performs an ink sucking action, ink is not sucked from the nozzle orifice on the print head 100 and ink recovered by the ink absorbing member 33 is sucked and discharged outside.

Figure 3:
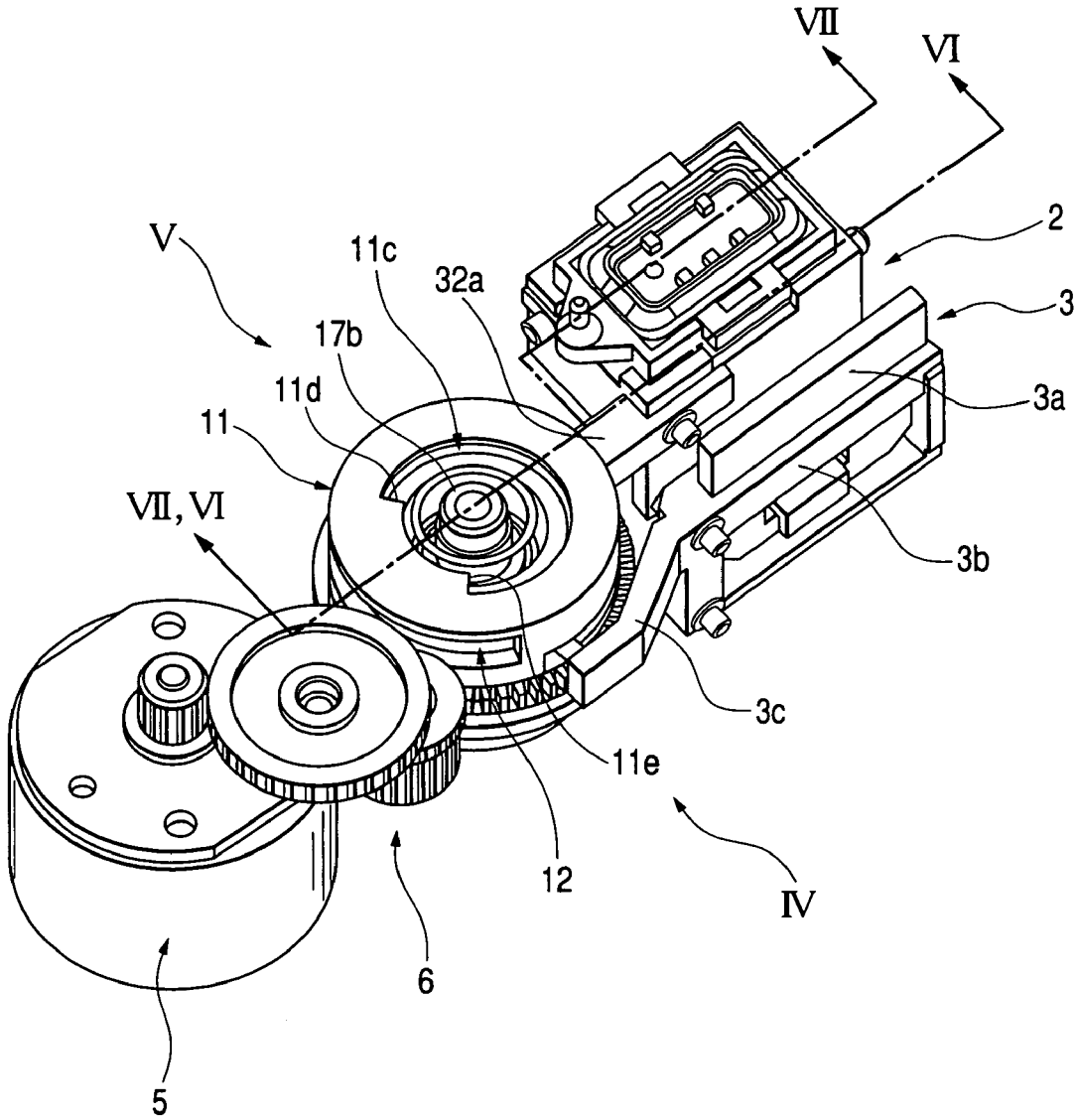
FIG. 3 is a perspective view showing the head maintenance mechanism of FIG. 1 with a housing removed.
Figure 4:
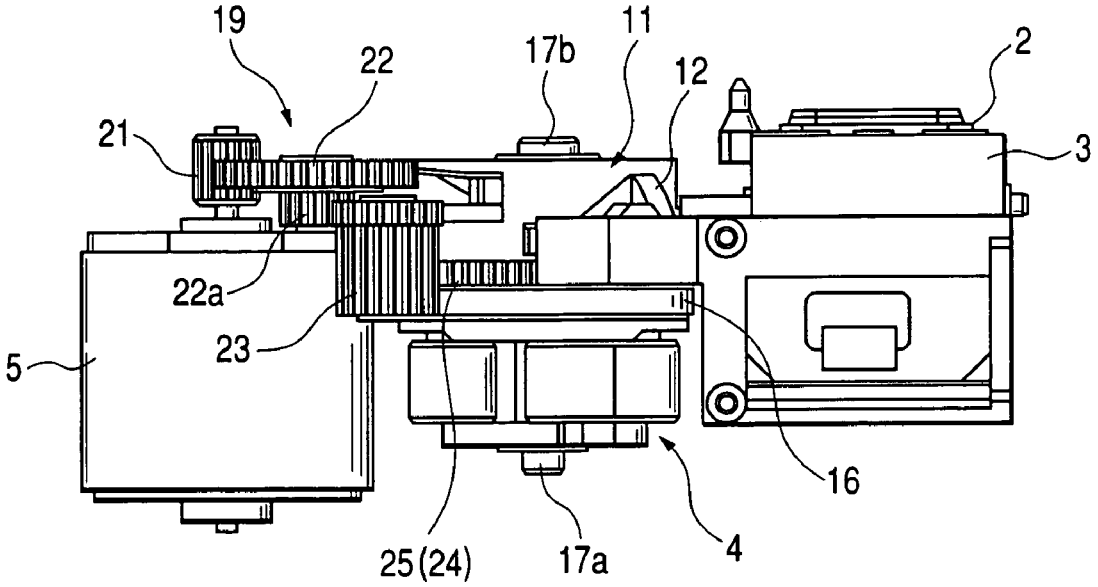
FIG. 4 is a side view of a head cap as viewed in a direction indicated by an arrow IV in FIG. 3.
Figure 5:
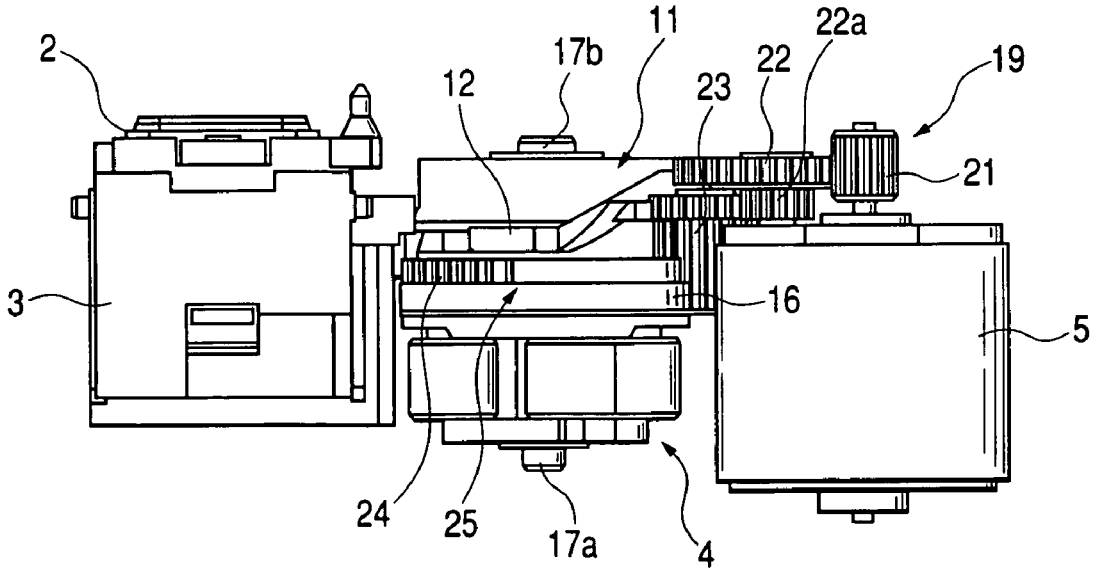
FIG. 5 is a side view of the head cap as viewed in a direction indicated by an arrow V in FIG. 3.
Figure 6:
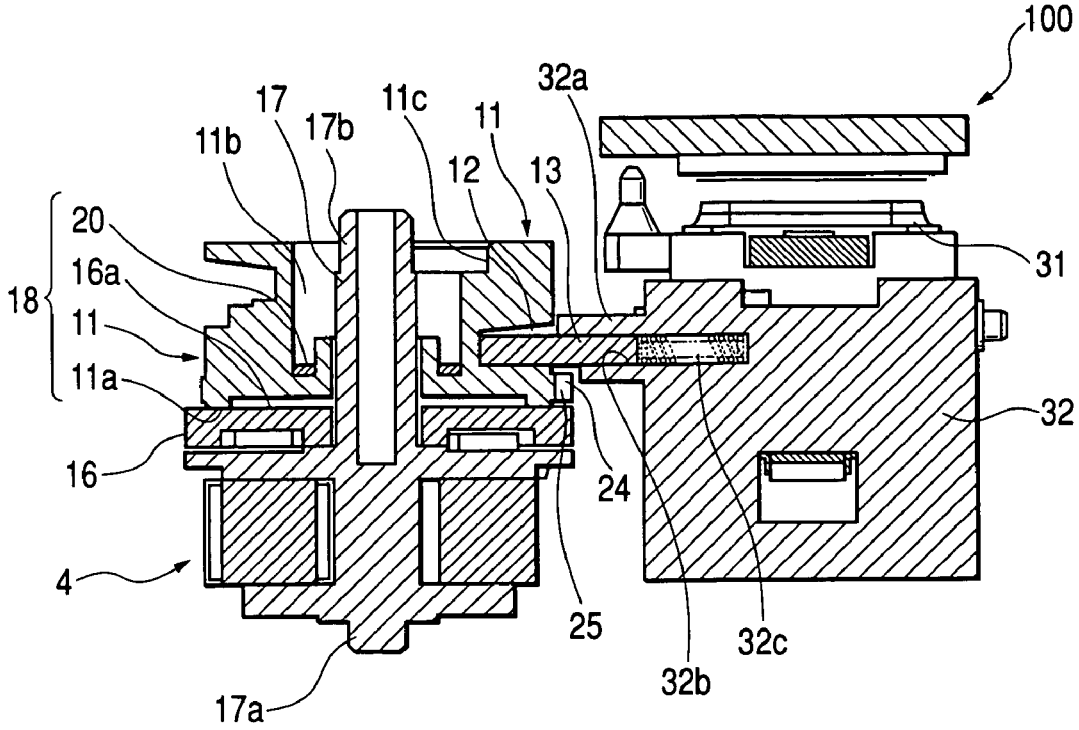
FIG. 6 is a partial, cross sectional view of the head cap taken along lines VI—VI in FIGS. 1 and 3.

As shown in FIGS. 2 and 3, the wiper 3 comprises a rectangular wiper blade 3*a*, and a blade holder 3*b* holding the blade, and the blade holder 3*b* is mounted on the housing 7 in a manner to be able to reciprocate between a retracted position and a wiping position in which the nozzle surface 101 of the print head 100 can be wiped. A horizontal arm 3*c* is extended from a side of the blade holder 3*b*, and the wiper driving pin 14 is mounted to a tip end of the horizontal arm 3*c*.

Next, the construction of the tube pump 4 will be described mainly with reference to FIGS. 2, 10, and 11. The tube pump 4 comprises a rotor 42 rotatably inserted into a circular recess 41 formed in the housing 7, the rotor 42 comprising the central shaft 17, a lower end plate 43 formed at a lower end of the shaft 17, and a roller driving disk 44 formed midway up the central shaft 17. A pair of rollers 45, 46 are rotatably mounted between the lower end plate 43 and the roller driving disk 44. An ink tube 47 is laid between the rollers 45, 46 and an inner peripheral surface 41*a* of the circular recess 41 on the housing 7. One end of the ink tube 47 is communicated to the ink discharging port 34 of the head cap 2, and the other end thereof is communicated to an ink recovery section (not shown).

An upper end surface of the roller driving disk 44 is opposed to a lower end surface of the pump gear 16. Formed at one position in a circumferential direction on both surfaces are engagement projections (not shown), and when the roller driving disk 44 rotates approximately 360 degrees, both projections engage with each other to cause the pump gear 16 and the tube pump 4 to rotate together.

Figure 10:
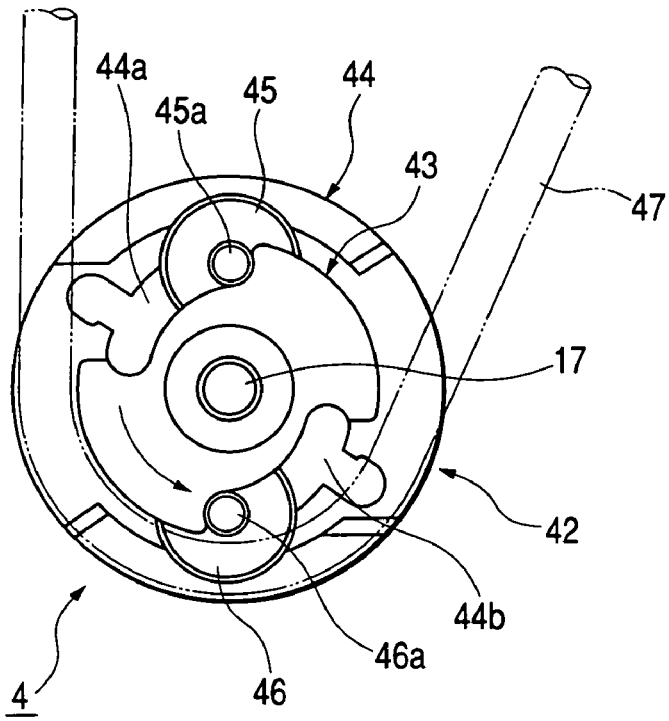
FIG. 10 is a bottom view showing a motion of a tube pump in the head maintenance mechanism of FIG. 1 under a pumping state.
Figure 11:
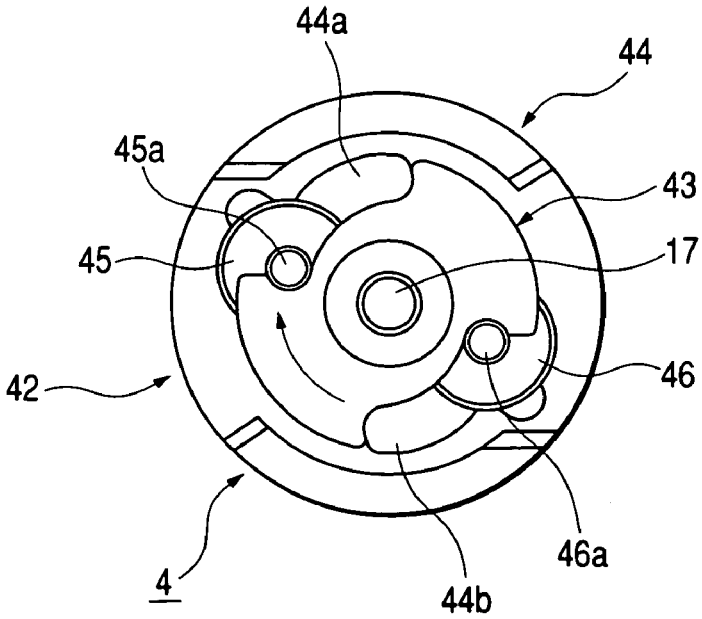
FIG. 11 is a bottom view showing a motion of a tube pump in the head maintenance mechanism of FIG. 1 under a pump release state.

Arcuate grooves 44*a*, 44*b* are formed on the roller driving disk 44 as shown in FIGS. 10 and 11 to guide central shafts 45*a*, 46*a* of the rollers 45, 46. When the tube pump 4 rotates in a direction indicated by an arrow in FIG. 10, the pair of rollers 45, 46 move radially outward along the arcuate grooves 44*a*, 44*b* to revolve while flattening the ink tube 47. Thereby, an ink sucking action (pumping action) is made. Meanwhile, when the tube pump 4 rotates in a reverse direction shown in FIG. 11, a release state, in which the ink tube 47 is not flattened, is created since the pair of rollers 45, 46 retract radially inward along the arcuate grooves 44*a*, 44*b*.

Figures 12A, 12B, 12C:
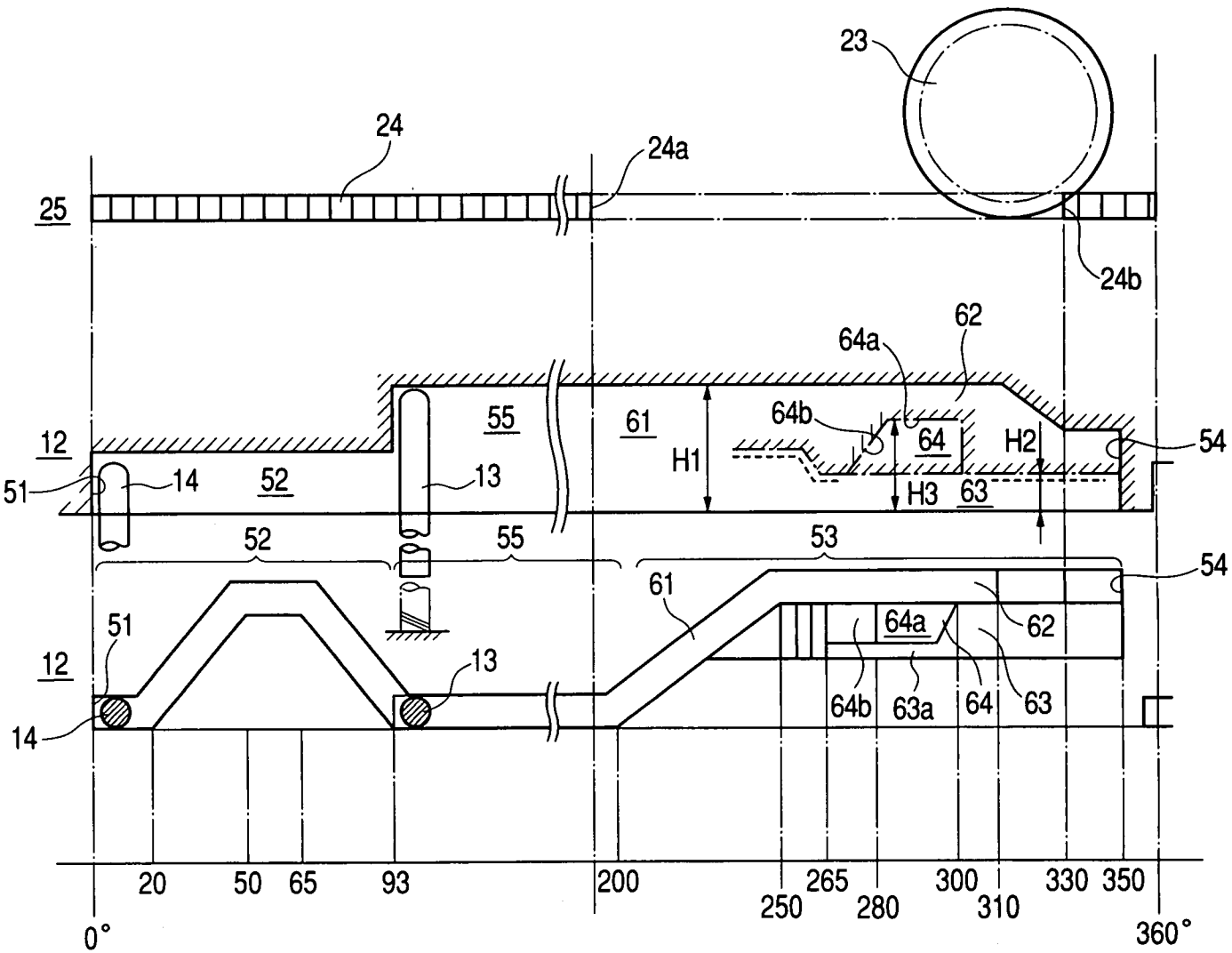
FIGS. 12A to 12C are diagrams explaining a cam groove of a cylindrical cam in the head maintenance mechanism of FIG. 1.

Next, a detailed explanation will be given to the cam groove 12 formed on the cylindrical cam 11 in the embodiment. FIG. 12A shows a development of the cam groove 12 of the cylindrical cam 11 in plan, FIG. 12B is a view showing groove depths of respective portions, and FIG. 12C is a view showing positions of the intermittent gear 25 and the reduction gear 23.

The cam groove 12 in the embodiment comprises a first dead end 51, against which the wiper driving pin 14 abuts, or close to which the wiper driving pin is disposed when the cylindrical cam 11 rotates counterclockwise, a wiper driving region 52, which is contiguous to the first dead end 51 and in which the wiper driving pin 14 is moved, a cap driving region 53, in which the cap driving pin 13 is moved, and a second dead end 54 formed at an end of the cap driving region 53. When the cylindrical cam 11 rotates clockwise, the cap driving pin 13 abuts against or is disposed close to the second dead end 54. In the embodiment, the cam groove 12 is formed over an angular range of approximately 350 degrees, and a connecting region 55 connects between the wiper driving region 52 and the cap driving region 53. Of course, wiper driving region 52 and cap driving region 53 may include discontinuous cam grooves.

Here, as described above, the dead ends of the cylindrical cam 11 in clockwise and counterclockwise rotation are defined by the stopper walls 11*d*, 11*e* of the cylindrical cam 11 and the projection 8*b* formed on the upper wall 8. In the embodiment, the cylindrical cam 11 rotates clockwise and the stopper wall 11*d* strikes against the projection 8*b*, whereby clockwise rotation of the cylindrical cam is stopped. In this state, the cap driving pin 13 abuts against the second dead end 54 or comes to a position immediate before it abuts against the second dead end 54. Conversely, the cylindrical cam rotates counterclockwise and the stopper wall 11*e* strikes against the projection 8*b*, whereby counterclockwise rotation of the cylindrical cam is stopped. In this state, the wiper driving pin 14 abuts against the first dead end 51 or comes to a position immediate before it abuts against the first dead end 51.

The wiper driving region 52 comprises a trapezoidal portion extending over an angular range of approximately 90 degrees, and the wiper driving pin 14 disposed at the first dead end 51 slides relative to and along the wiper driving region 52 to move up and down when the cylindrical cam 11 rotates clockwise. When the cylindrical cam 11 rotates approximately 45 degrees, the wiper 3 comes to the wiping position enabling wiping the nozzle surface 101 from the retracted position, and when the cylindrical cam 11 further rotates approximately 45 degrees, it returns to the retracted position again. In a state in which the wiper driving pin 14 is disposed in the connecting region 55 of the cam groove 12 as shown in FIG. 12A, the wiper 3 rises to the wiping position and then returns to the retracted position when the cylindrical cam rotates counterclockwise.

The cap driving region 53 comprises a slope portion 61 contiguous to the horizontally extending connecting region 55 and slanted upward at a predetermined angle, an upper horizontal portion 62 contiguous to an upper end of the slope portion 61 and extending horizontally, and a lower horizontal portion 63 formed in parallel to and below the upper horizontal portion 62. Also, the cap driving region 53 further comprises a guide portion 64 for guiding the cap driving pin 13, which is disposed at adjacent the second dead end 54 of the upper horizontal portion 62, to the lower horizontal portion 63 when the cylindrical cam 11 rotates counterclockwise.

In a state in which the cap driving pin 13 is disposed in the connecting region 55 shown in FIG. 12A, the head cap 2 is disposed in the retracted position 2A (see FIG. 7). In this state, when the cylindrical cam 11 rotates clockwise, the cap driving pin 13 rises along the slope portion 61 to reach the upper horizontal portion 62. This state corresponds to an ink sucking position 2B in which the head cap 2 caps the nozzle surface 101 in a state, in which the vent valve mechanism 35 is closed, as shown in FIG. 8. In contrast, a state, in which the cap driving pin 13 is disposed in the lower horizontal portion 63, corresponds to an idle sucking position 2C, in which the head cap 2 caps the nozzle surface 101 in a state, in which the vent valve mechanism 35 is opened, as shown in FIG. 9.

Here, as seen from FIG. 12B, a groove depth H1 is deepest in the connecting region 55, the slope portion 61, and the upper horizontal portion 62, while a groove depth of the upper horizontal portion 62 gradually decreases from a portion on a side of the second dead end 54 and is made constant over a portion up to the second dead end 54. Also, a groove side of a lower portion of the upper horizontal portion 62 is cut out in a stepwise manner to form a lower horizontal portion 63 having a small groove depth H2. The lower horizontal portion 63 extends between the second dead end 54 and the slope portion 61.

The guide portion 64 is formed by cutting out a bottom surface of the lower horizontal portion 63 while leaving a lower portion 63*a*, and comprises a portion 64*a* having a groove depth H3 between groove depths of the portions 62, 63, and a portion 64*b*, of which groove depth gradually decreases from the portion 64*a* to the slope portion 61. An end of the portion 64*a* is situated near the portion at which the groove depth of the upper horizontal portion 62 starts decreasing, or the portion at which the groove depth of the upper horizontal portion 62 is decreasing. An end of the portion 64*b* is continuous to the lower horizontal portion 63

Figure 13:
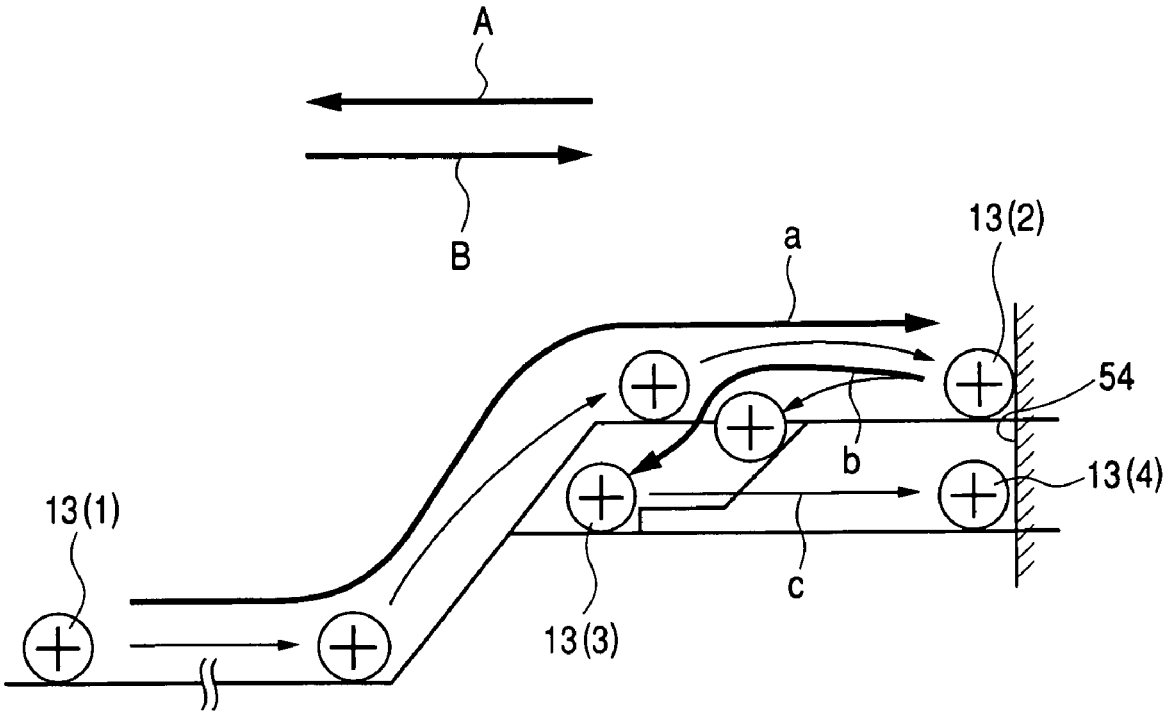
FIG. 13 is a view showing a movement of a cap driving pin, which moves along a cap driving region of the cam groove.

FIG. 13 is a view showing a movement of the cap driving pin 13, which moves along the cap driving region 53 provided with these portions 61 to 64. Explained with reference to the figure, when the cylindrical cam 11 rotates in a clockwise direction A, the cap driving pin 13 moves along the slope portion 61 from a position 13(1) in the connecting region 55 as shown by an arrow "a" to be guided into the upper horizontal portion 62 to reach the second dead end 54.

When the cylindrical cam 11 rotates in a counterclockwise direction B in a state in which the cap driving pin 13 is disposed in the position 13(2), the cap driving pin 13 moves in an opposite direction along the upper horizontal portion 62 as shown by an arrow "b" and when reaching the guide portion 64, the cap driving pin falls onto the guide portion 64 from the upper horizontal portion 62 to descend along the portion to reach the lower horizontal portion 63.

When the cylindrical cam 11 rotates in the clockwise direction A again in a state in which the cap driving pin 13 is disposed in the position 13(3), the cap driving pin 13 moves in the lower horizontal portion 63 along the narrow groove bottom 63*a* to reach a position 13(4) on the second dead end 54.

Here, the teeth 24 of the intermittent gear 25 formed on the cylindrical cam 11 are formed over an angular range from an angular position near the second dead end 54 in the cam groove 12 to an angular position near the slope portion 61 (see FIG. 12C). In other words, in the case where the cylindrical cam 11 rotates clockwise, in a rotating angle position immediate before the cap driving pin 13 moving relative to and along the cam groove 12 abuts against the second dead end 54 of the cam groove 12, one end 24*a* of the teeth 24 of the intermittent gear 25 passes the reduction gear 23 to be released of meshing with the reduction gear 23. Also, in the case where the cylindrical cam 11 rotates counterclockwise, in a rotating angle position immediate before the wiper driving pin 14 moving relative to and along the cam groove 12 abuts against the first dead end 51 of the cam groove 12, the other end 24*b* of the teeth 24 of the intermittent gear 25 passes the reduction gear 23 to be released of meshing with the reduction gear 23.

Figure 14:
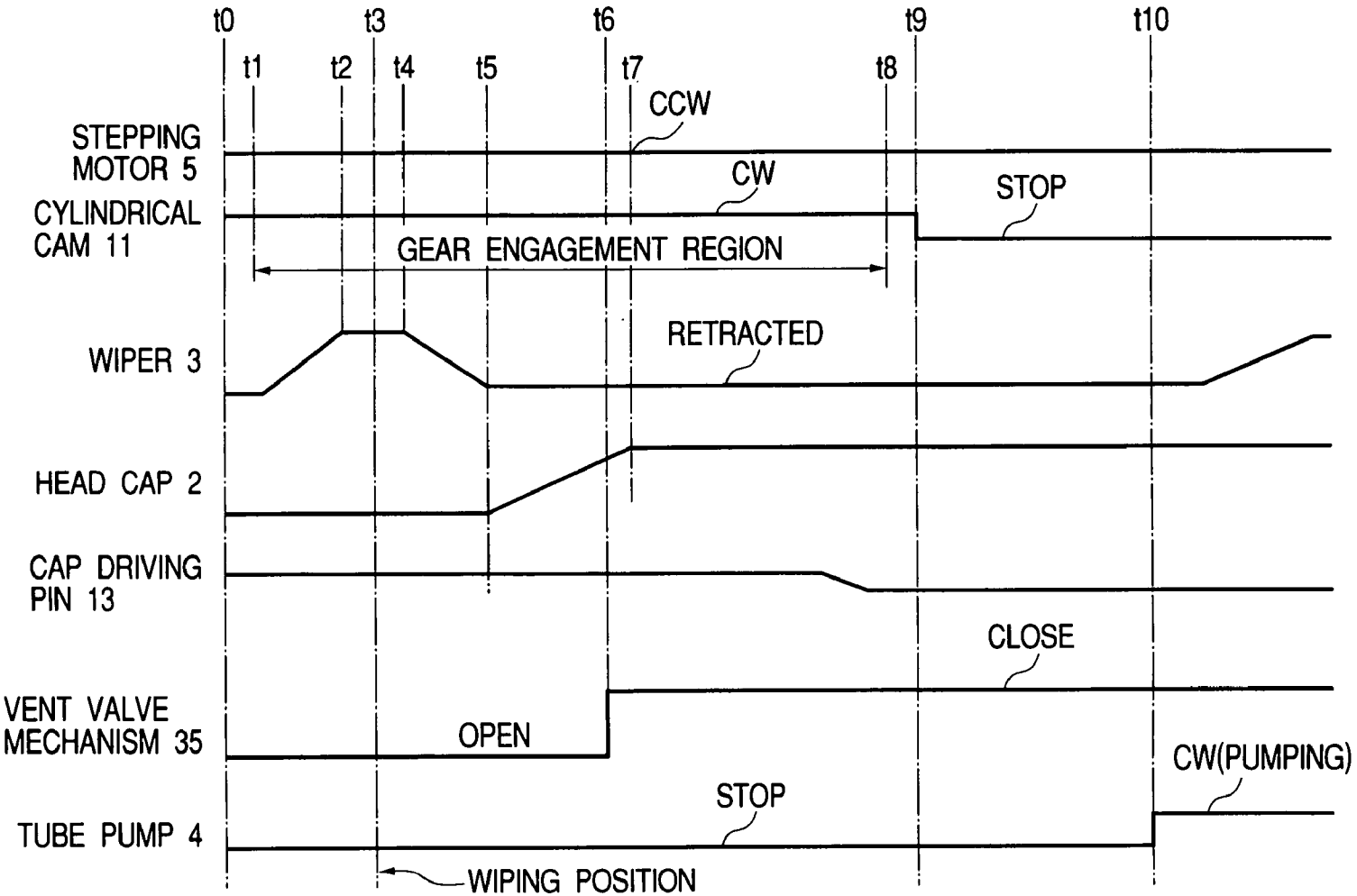
FIG. 14 is a timing chart indicating the operation in a case where the head cap in an initial position is moved to the ink sucking position.
Figure 15:
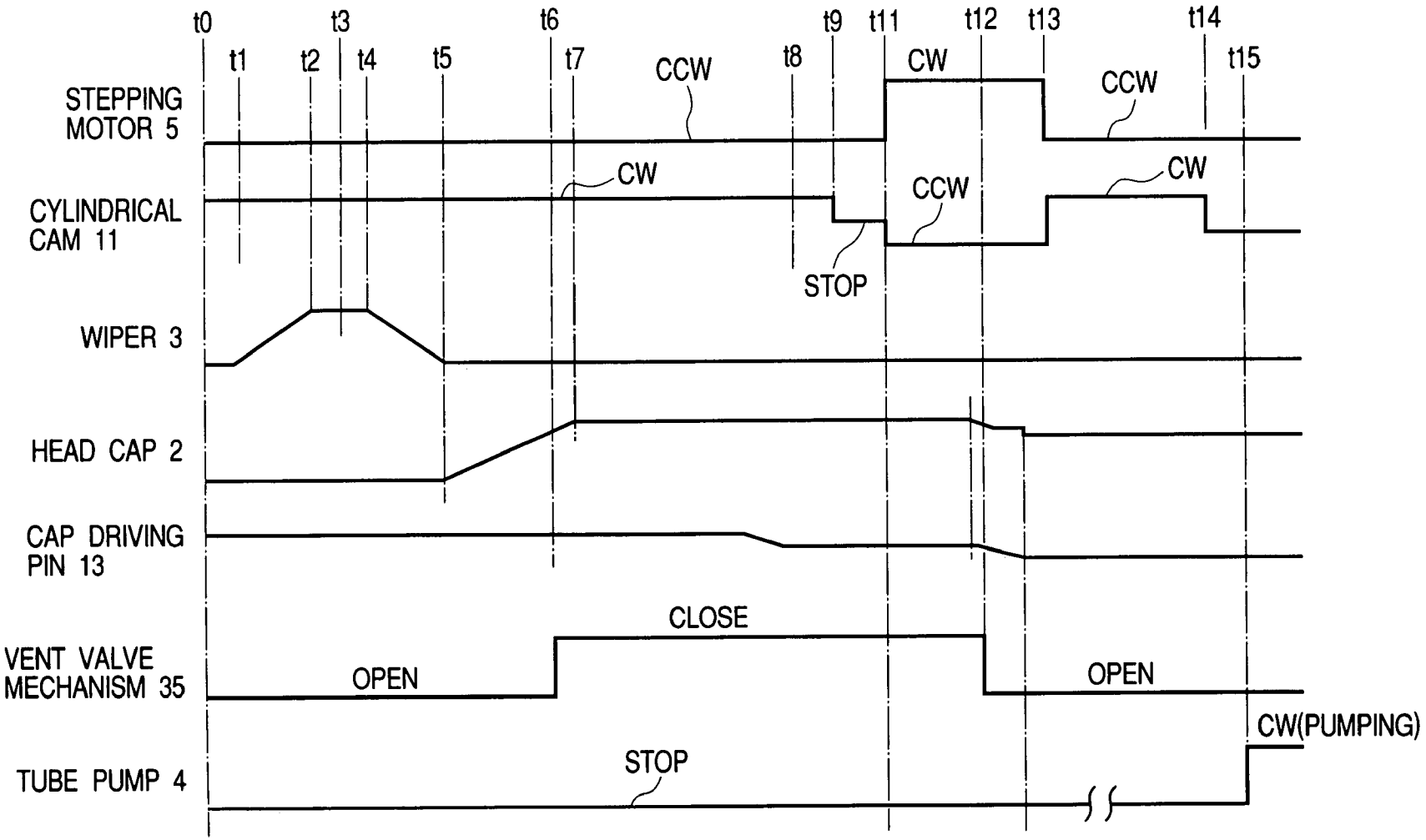
FIG. 15 is a timing chart indicating the operation in a case where the head cap in the initial position is moved to the idle sucking position.
Figure 16A:
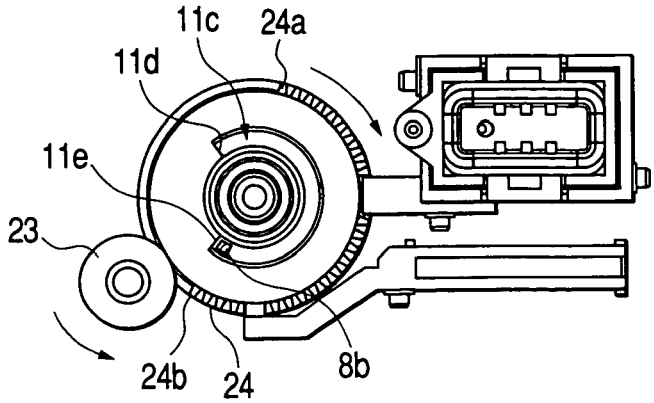
FIGS. 16A to 16D are views illustrating the positional relationship of the cylindrical cam, the cap driving pin, and a wiper driving pin in respective points of time.

Next, operation of the head maintenance mechanism 1 according to the embodiment will be described mainly with reference to FIGS. 14 to 16. First, an explanation will be given to the operation when the head cap 2 is moved to the ink sucking position 2B from the retracted position 2A. The cap driving pin 13 and the wiper driving pin 14 are disposed in initial positions shown in FIG. 12, and FIG. 16A shows the positional relationship of respective parts in the initial positions. One end 24*b* of the teeth 24 of the intermittent gear 25 is in a position slightly offset counterclockwise relative to the reduction gear 23.

When the stepping motor 5 is reversely rotated in this state (point of time t0, the reduction gear 23 rotates counterclockwise. The pump gear 16 meshing with the reduction gear 23 rotates clockwise A, and the cylindrical cam 11 connected to the pump gear 16 via the frictional clutch mechanism 18 also rotates clockwise A. When the cylindrical cam 11 rotates clockwise A, the teeth 24 of the intermittent gear 25 shift to a state of meshing with the reduction gear 23 in the meantime (point of time t1, and thereafter torque of the stepping motor 5 is transmitted to the cylindrical cam 11 not through the frictional clutch mechanism 18. Therefore, the cylindrical cam 11 can be surely rotated even when load on the cylindrical cam 11 increases.

Owing to clockwise rotation of the cylindrical cam 11, the wiper driving pin 14 sliding relative to the cam groove 12 slides along the wiper driving region 52 of the cam groove 12 to lift the wiper 3 to the wiping position from the retracted position (from point of time t2 to point of time t4. At this point of time t3, the print head 100 is moved via the position of the wiper 3 to thereby permit the wiper blade 3*a* to wipe the nozzle surface 101.

Figure 16B:
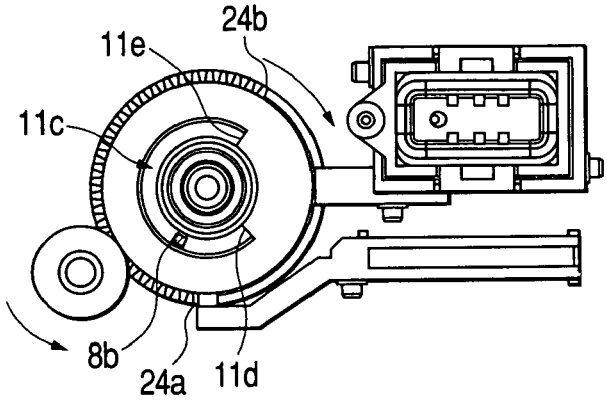

When the cylindrical cam 11 rotates further, the wiper 3 descends and returns to the retracted position (point of time t5), the cap driving pin 13 begins ascending along the slope portion 61 of the cam groove 12. Thereby, the head cap 2 begins ascending from the retracted position 2A. Before a point of time t6 which is immediate before a point of time t7 when the cap driving pin 13 reaches the upper horizontal portion 62 of the cam groove 12, the cap body 31 of the head cap 2 is put in a state to cap the nozzle surface 101 of the print head 100 having stood by immediately above, and thereafter only the cap holder 32 ascends and the cap body 31 is relatively depressed downward. As a result, the vent valve mechanism 35 of the head cap 2 shifts to a closed state at a point of time t6 and thereafter the head cap 2 reaches the ink sucking position 2B. This state is shown in FIGS. 8 and 16B.

Subsequently, when the cylindrical cam 11 rotates further clockwise, one end 24*a* of the teeth 24 of the intermittent gear 25 of the cylindrical cam 11 passes the reduction gear 23, so that meshing of the intermittent gear 25 and the reduction gear 23 is released (point of time t8). Thereafter, the cylindrical cam 11 rotates together with the pump gear 16 via the frictional clutch mechanism 18, and the cap driving pin 13 is disposed at the second dead end 54 of the cam groove 12 at a point of time t9.

Figure 16C:
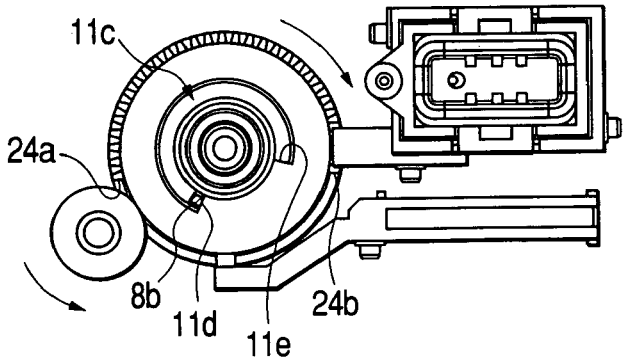

In this state, the stopper wall 11*d* of the cylindrical cam 11 strikes against the projection 8*b* of the upper wall 8 to inhibit rotation of the cylindrical cam 11. Accordingly, slip is then generated in the frictional clutch mechanism 18, so that the cylindrical cam 11 makes no rotation and is held in a stop state and only the pump gear 16 continues to rotate. FIG. 16C shows this state. When the pump gear 16 makes substantially one revolution from the initial position, the pump gear 16 engages with the roller driving disk 44 of the tube pump 4 (a point of time t10), and the tube pump 4 is then drivingly rotated clockwise. As a result, the pair of rollers 45, 46 revolve while flattening the ink tube 47 as shown in FIG. 10, and ink suction is performed in the head cap 2 capped in a state in which the vent valve mechanism 35 is closed. As a result, ink is sucked from the nozzle orifice on the print head 100 to be discharged outside.

Figure 16D:
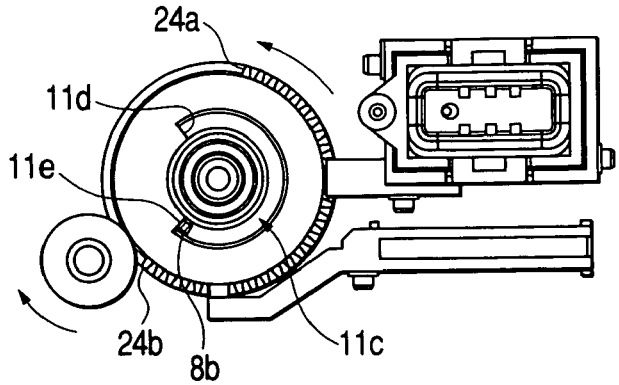

When the stepping motor 5 is rotated forward after the ink sucking action is terminated, a reverse operation to the above is effected and the respective parts are returned to an initial state. More specifically, the cylindrical cam 11 rotates counterclockwise to a position where the wiper driving pin 14 is disposed at the first dead end 51 of the cam groove 12 (state at a point of time t0). In a state in which the wiper driving pin 14 is disposed at the first dead end 51 of the cam groove 12, the stopper wall 11*e* of the cylindrical cam 11 strikes against the projection 8*b* of the upper wall 8 to inhibit rotation of the cylindrical cam 11. Accordingly, slip is then generated in the frictional clutch mechanism 18 so that the cylindrical cam 11 is held in that position. Meanwhile, the pump gear 16 continues to rotate counterclockwise to rotate the tube pump 4 counterclockwise, and the pair of rollers 45, 46 retract radially inward to establish a pump release state in which flattening of the ink tube 47 is released. This state is shown in FIG. 16D, the relative positions of the respective parts being the same as those in the initial state shown in FIG. 16A.

Next, an explanation will be given to the operation when the head cap 2 is moved to the idle sucking position 2C with reference to FIG. 15. In this case, the operation until the point of time t9 in FIG. 15 is also the same as described above. At the point of time t9, the head cap 2 reaches the ink sucking position 2B and the cap driving pin 13 is disposed at the second dead end 54 of the cam groove 12.

Thereafter, at the point of time t11, the rotation of the stepping motor 5 is reversed in a forward direction (clockwise direction) for a predetermined period of time (from the point of time t11 to a point of time t13). As a result, the cylindrical cam 11 rotates counterclockwise such that the cap driving pin 13 moves within the cam groove 12 along a path indicated by an arrow b in FIG. 13, and reach the lower horizontal portion 63 at the point of time t13. Here, since the cap holder 32 of the head cap 2 descends, the cap body 31 pressed against the nozzle surface 101 is relatively pushed upward while being kept in the capping state, and the vent valve mechanism 35 having been in a closed state returns to an open state at the point of time t12 immediate before the point of time t13.

When the stepping motor 5 is reversely driven in the counterclockwise direction at the point of time t13, the cylindrical cam 11 rotates clockwise to cause the cap driving pin 13 to slide along the lower horizontal portion 63 of the cam groove 12 to be disposed at the second dead end 54 (at a point of time t14). After this time of point, only the pump gear 16 rotates while the cylindrical cam 11 stops. After a point of time t15, the pump gear 16 engages with the roller driving disk 44 of the tube pump 4 to drive the tube pump 4, thus starting the ink suction. In this state, since the vent valve mechanism 35 of the head cap 2 is opened, ink is not sucked from the nozzle orifice but ink contained in the ink absorbing member 33 is sucked and discharged outside (that is, idle suction is performed).

After the idle suction is performed, rotating the stepping motor 5 forwardly, the cylindrical cam 11 rotates counterclockwise, so that the cap driving pin 13 situated in the second dead end 54 is moved along the lower horizontal portion 63 to the initial position via the slope portion 61.

As described above, with the head maintenance mechanism 1 of the ink jet printer in the embodiment, rotation of the stepping motor 5 is transmitted to the cylindrical cam 11 through the reduction gear mechanism 19, the pump gear 16, and the frictional clutch mechanism 18. Also, in an operating state, in which there is no need of causing the cylindrical cam 11 to move the head cap 2 and the wiper 3, the stopper walls 11*d*, 11*e* of the cylindrical cam 11 are made to strike against the projection 8*b* of the upper wall 8 to inhibit rotation of the cylindrical cam 11 to generate slip in the frictional clutch mechanism 18, thereby enabling rotation of only the pump gear 16 for driving of the tube pump.

Accordingly, the cylindrical cam 11 rotates clockwise or counterclockwise only in a range of rotating angle prescribed by the stopper walls 11*d,* 11*e,* and so can be constantly returned to the initial or reference position. Therefore, unlike the case where a cylindrical cam continuously rotated in the same direction by one direction of a motor is used to drive a head cap, wiper or an ink suction pump, there is no need of providing a detector for detecting the position of a cylindrical cam and the respective parts can be operatively controlled on the basis of the number of steps in the stepping motor 5. As a result, it is possible to realize inexpensive drive control of good controllability.

Also, it is possible to use the tube pump 4 to control an amount of ink as sucked on the basis of the number of steps in the stepping motor 5.

Further, since the pump gear 16 is rotated clockwise and counterclockwise, the tube pump 4 can be switched between a pumping state, in which the rollers 45, 46 revolve while flattening the ink tube 47, and a pump release state, in which the rollers 45, 46 retract from the ink tube 47. Therefore, unlike a head maintenance mechanism, in which an ink suction pump is driven only in rotation in one direction, a state of a pump can be switchingly controlled by forward and rearward rotation of a motor.

Besides, since play of about 360 degrees is present between the pump gear 16 and the tube pump 4, the tube pump 4 does not operate when only the capping action and the wiping action from the pump release state are made. Therefore, an unnecessary action of the tube pump 4, that is, the flattening action of the ink tube 47 can be avoided, so that it is possible to maintain durability of the ink tube 47. Also, since the ink tube 47 is not flattened in the capping state, there is obtained an effect that there is no deformation of the ink tube 47.

Also, the upper horizontal portion 62 and the lower horizontal portion 63 are formed in the cam groove 12 of the cylindrical cam 11 so that when the cylindrical cam 11 is rotated counterclockwise, the cap driving pin 13 disposed at the upper horizontal portion 62 is guided to the lower horizontal portion 63 through the guide portion 64. Accordingly, a state, in which capping of the head cap 2 is made in a closed state to permit ink to be sucked from the nozzle orifice, and a state, in which capping of the head cap 2 is made in an atmospheric opening state to permit ink to be sucked from the ink absorbing member 33 but not to permit ink to be sucked from the nozzle orifice can be realized without separate provision of a drive mechanism for driving of the vent valve mechanism 35.

Besides, with the embodiment, the pump gear 16 and the tube pump 4 are provided below the cylindrical cam 11 in a coaxial manner, so that an installation space therefor, in particular, an installation area in a lateral direction can be considerably reduced so that a very compact head maintenance mechanism can be realized.

Further, with the embodiment, the rotation stop position of the cylindrical cam 11 is prescribed by engagement between the stopper walls 11*d*, 11*e* of the cylindrical cam 11 and the projection 8*b* of the upper wall 8. Rotation of the cylindrical cam can be restricted by engagement of the cap driving pin 13 and the second dead end 54 and engagement of the wiper driving pin 14 and the first dead end 51. In this case, clutch forces are applied on the respective pins 13, 14 to cause movements of the head cap 2 and the wiper 3, so that failure of positioning relative to the print head 100 or the like is liable to occur, and fixing portions (mount portions) of the respective pins 13, 14 are also liable to cause a problem in durability. In the embodiment, the projection 8*b* formed on the upper wall 8 fixed to the housing 7 receives forces for stopping the rotation of the cylindrical cam, so that failure of positioning of the head cap 2 and the wiper 3 can be avoided and mount portions of the respective pins 13, 14 cause no problem in durability.

While a tube pump is used as an ink suction pump in the above embodiment, other ink suction pumps can be also used.

Also, while a stepping motor drives the head cap, wiper and the tube pump in the above embodiment, the invention can be likewise applied to, for example, the head maintenance mechanism configured to drive only the head cap and the ink suction pump.

Further, while the cam groove is a single cam groove extending substantially continuously over an angular range of at most 360 degrees, it can be formed as a cam groove comprising a portion for driving of a wiper and a portion for driving of a head cap, which portions are discontinuous or separate. Also, the angular range of the cam groove can be 360 degrees or more.

Also, while the intermittent gear can be used in the above embodiment to smoothly and surely rotate the cylindrical cam even when a large load is applied on the cylindrical cam, it is possible to omit the intermittent gear in the case where load applied on the cylindrical cam is small.

In addition, in the case where a force for preventing rotation of the cylindrical cam 11 is small, it is also possible in the above embodiment to omit the stopper walls 11*d,* 11*e* and the projection 8*b* of the upper wall 8 for restricting the cylindrical cam 11 and then to restrict the rotation of the cylindrical cam 11 by engagement of the respective pins 13, 14 and the respective dead ends 54, 51.

What is claimed is:

1. A maintenance mechanism for a print head having a nozzle surface in which are formed a plurality of nozzles, comprising:

a head cap, reciprocally movable between a capping position for covering the nozzles and a retracted position separated from the nozzle surface;

a pump, connected to the head cap;

a drive source;

a transmission member, rotated by the drive source to drive the pump;

a cam, reciprocally rotatable between a first position and a second position to reciprocally move the head cap; and a clutch, which rotates the cam together with the transmission member, but rotates only the transmission member when the cam reaches each one of the first position and the second position.

2. The maintenance mechanism as set forth in claim 1, wherein:

a cam groove is formed on an outer peripheral surface of the cam in a predetermined circumferential angular range; and the maintenance mechanism further comprises a cap driving pin slidably movable along the cam groove to reciprocally move the head cap.

3. The maintenance mechanism as set forth in claim 2, wherein a rotation of the cam in a first direction is stopped when the cap driving pin reaches at a first dead end of the cam groove, and a rotation of the cam in a second direction is stopped when the cap driving pin reaches at a second dead end of the cam groove.

4. The maintenance mechanism as set forth in claim 2, wherein the head cap includes:

a cap body having an opening which faces the nozzle surface;

a cap holder, which holds the cap body;

an urging member, disposed in the cap holder to urge the cap body in a direction that the cap body is projected from the cap holder; and a vent valve, closed when the cap body of the head cap placed at the capping position is pushed toward the cap holder by a predetermined amount against an urging force of the urging member, so that an interior space of the head cap is isolated from atmosphere.

5. The maintenance mechanism as set forth in claim 4, wherein the cam groove includes:

a first portion which moves the cap driving pin so as to place the cap holder at a first capping position where the cap body covers the nozzles and the vent valve is closed; and a second portion which moves the cap driving pin so as to place the cap holder at a second capping position where the cap body covers the nozzles and the vent valve is opened.

6. The maintenance mechanism as set forth in claim 5, wherein:

the cam groove includes a guide portion which guides the cap driving pin situated in the first portion to the second portion; and wherein the cap driving pin situated in the vicinity of one end of the first portion is guided to the second portion via the guide portion, when the cap driving pin is moved away from the one end of the first portion.

7. The maintenance mechanism as set forth in claim 6, wherein:

the first portion includes a depth-decreasing portion in which a depth thereof gradually decreases toward the one end thereof; and the guide portion connects a part in the first portion in the vicinity of the depth-decreasing portion and the second portion.

8. The maintenance mechanism as set forth in claim 2, wherein the cam groove is one continuous groove, and the predetermined circumferential angular range is 360 degrees or less.

9. The maintenance mechanism as set forth in claim 2, further comprising:

a wiper, reciprocally movable between a wiping position for wiping the nozzle surface and a standby position; and a wiper driving pin, slidably moving along the cam groove to reciprocally move the wiper, wherein the cam groove includes:

a first dead end portion, at which the wiper driving pin is placed when a rotation of the cam in a first direction is stopped;

a wiper driving portion, continued from the first dead end portion, which moves the wiper driving pin to reciprocally move the wiper;

a second dead end portion, at which the cap driving pin is placed when a rotation of the cam in a second direction is stopped; and a cap driving portion, continued from the second dead end portion, which moves the cap driving pin to reciprocally move the head cap.

10. The maintenance mechanism as set forth in claim 9, wherein the pump is a tube pump which performs a sucking operation only when the cam is rotated in the second direction.

11. The maintenance mechanism as set forth in claim 10, wherein the pump is arranged coaxially with the cam.

12. The maintenance mechanism as set forth in claim 9, further comprising an intermittent gear arranged coaxially with the cam, so as to rotate integrally with the cam, wherein a driving force of the drive source is transmitted to the intermittent gear only in a predetermined circumferential angular range of the cam between the first dead end portion and the second dead end portion of the cam groove.

13. The maintenance mechanism as set forth in claim 2, further comprising an urging member which urges the cap driving pin toward a bottom surface of the cam groove.

14. The maintenance mechanism as set forth in claim 1, wherein:

a first engagement member and a second engagement member are provided with the cam, and a third engagement member is disposed at a predetermined position; and a rotation of the cam in a first direction is stopped when the first engagement member engages with the third engagement member, and a rotation of the cam in a second direction is stopped when the second engagement member engages with the third engagement member.

15. The maintenance mechanism as set forth in claim 14, wherein the transmission member and the cam are coaxially arranged.

16. The maintenance mechanism as set forth in claim 15, wherein the clutch includes an urging member which presses one circular end surface of the transmission member and one end surface of the cam together.

17. The maintenance mechanism as set forth in claim 14, wherein the pump is a tube pump which performs a sucking operation only when the cam is rotated in either one of the first direction and the second direction.

18. The maintenance mechanism as set forth in claim 17, wherein the pump is arranged coaxially with the cam.

19. The maintenance mechanism as set forth in claim 1, further comprising an intermittent gear arranged coaxially with the cam, so as to rotate integrally with the cam, wherein a driving force of the drive source is transmitted to the intermittent gear only in a predetermined circumferential angular range of the cam between the first position and the second position.

20. An ink jet printer comprising the maintenance mechanism as set forth in claim 1.

* * * * *